US007726768B2

(12) United States Patent
Tsuchii

(10) Patent No.: US 7,726,768 B2
(45) Date of Patent: Jun. 1, 2010

(54) INK JET PRINTING APPARATUS AND PRINTING METHOD

(75) Inventor: Ken Tsuchii, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 221 days.

(21) Appl. No.: 12/065,594

(22) PCT Filed: Dec. 11, 2006

(86) PCT No.: PCT/JP2006/325122

§ 371 (c)(1),
(2), (4) Date: Mar. 3, 2008

(87) PCT Pub. No.: WO2007/066834

PCT Pub. Date: Jun. 14, 2007

(65) Prior Publication Data

US 2009/0267981 A1 Oct. 29, 2009

(30) Foreign Application Priority Data

Dec. 9, 2005 (JP) ..... 2005-356313

(51) Int. Cl.
*B41J 29/393* (2006.01)

(52) U.S. Cl. ..... 347/19; 347/15; 347/43

(58) Field of Classification Search ..... 347/12, 347/15, 19, 40, 43; 358/1.2, 1.9
See application file for complete search history.

(56) References Cited

U.S. PATENT DOCUMENTS 5,568,169 A * 10/1996 Dudek et al. ..... 347/43
5,659,342 A 8/1997 Lund et al.
6,084,604 A * 7/2000 Moriyama et al. ..... 347/15
6,471,323 B2 * 10/2002 Shibata et al. ..... 347/15
2006/0279600 A1 12/2006 Matsumoto et al.

FOREIGN PATENT DOCUMENTS

EP 0 704 307 4/1996
JP 55-139269 10/1980

(Continued)

OTHER PUBLICATIONS

International Preliminary Report on Patentability, International Application No. PCT/JP2006/325122, filed on Dec. 11, 2006 (6 pages).

*Primary Examiner*—Lamson D Nguyen
(74) *Attorney, Agent, or Firm*—Fitzpatrick, Cella, Harper & Scinto

(57) ABSTRACT

A dark color (for example, cyan) ink dot formed by preliminary ejection can be made less noticeable, and the influence on the printing quality can be reduced, even in a case where the dark color ink is preliminarily ejected onto a light color (for example, yellow) image area. For this purpose, in a case where the dark color ink is preliminarily ejected onto the image area of high lightness, the amount of the ink applied for printing the area is reduced. For example, in a case where a cyan ink is preliminarily ejected onto an area to be formed of yellow dots, a piece of data for forming the yellow dot in the preliminary ejection position is deleted. This reduces an overlapping area of the yellow area and the ink dot formed by the preliminary ejection, and thus makes the ink dot formed by the preliminary ejection less noticeable.

12 Claims, 12 Drawing Sheets

FOREIGN PATENT DOCUMENTS

| | | |
|---|---|---|
| JP | 1-174459 | 7/1989 |
| JP | 4-361048 | 12/1992 |
| JP | 5-330078 | 12/1993 |
| JP | 6-40042 | 2/1994 |
| JP | 8-112904 | 5/1996 |
| JP | 2001-26123 | 1/2001 |
| JP | 2006-341519 | 12/2006 |

* cited by examiner

IMAGE DATA (YELLOW)
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | Y | Y | Y | | |
| m+1 | | | Y | Y | Y | | |
| m+2 | | | Y | Y | Y | | |
| m+3 | | | | | | | |
| m+4 | | | | | | | |

FIG.4A

PRELIMINARY EJECTION DATA
COLUMNS
(MAIN-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | | | | | |
| m+1 | | | | C | | | |
| m+2 | | | | | | | |
| m+3 | | | | | | | |
| m+4 | | | | | | | |

FIG.4B

PRINT DATA
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | Y | Y | Y | | |
| m+1 | | | Y | C | Y | | |
| m+2 | | | Y | Y | Y | | |
| m+3 | | | | | | | |
| m+4 | | | | | | | |

FIG.4C

DOT OVERLAPPING AREA

OVERLAP OF PRINTED DOTS
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | Y | Y | Y | | |
| m+1 | | | Y | C | Y | | |
| m+2 | | | Y | Y | Y | | |
| m+3 | | | | | | | |
| m+4 | | | | | | | |

FIG.4D

IMAGE DATA (YELLOW)
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | Y | Y | Y | | |
| m+1 | | | Y | | Y | | |
| m+2 | | | Y | Y | Y | | |
| m+3 | | | | | | | |
| m+4 | | | | | | | |

FIG.5A

PRELIMINARY EJECTION DATA
COLUMNS
(MAIN-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | | | | | |
| m+1 | | | | C | | | |
| m+2 | | | | | | | |
| m+3 | | | | | | | |
| m+4 | | | | | | | |

FIG.5B

PRINT DATA
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | Y | | Y | | |
| m+1 | | | | C | | | |
| m+2 | | | Y | | Y | | |
| m+3 | | | | | | | |
| m+4 | | | | | | | |

FIG.5C

DOT OVERLAPPING AREA

OVERLAP OF PRINTED DOTS
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | Y | | Y | | |
| m+1 | | | | C | | | |
| m+2 | | | Y | | Y | | |
| m+3 | | | | | | | |
| m+4 | | | | | | | |

FIG.5D

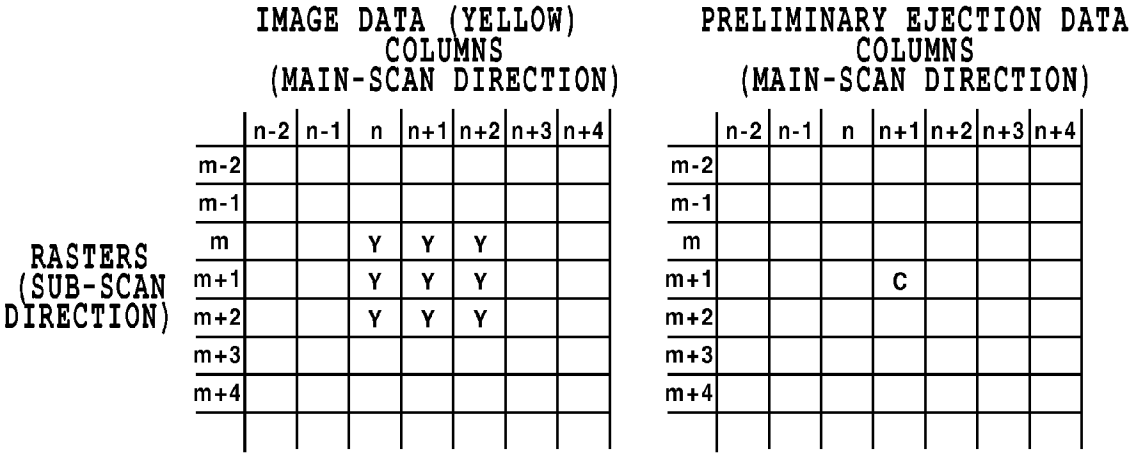
FIG.6A
FIG.6B
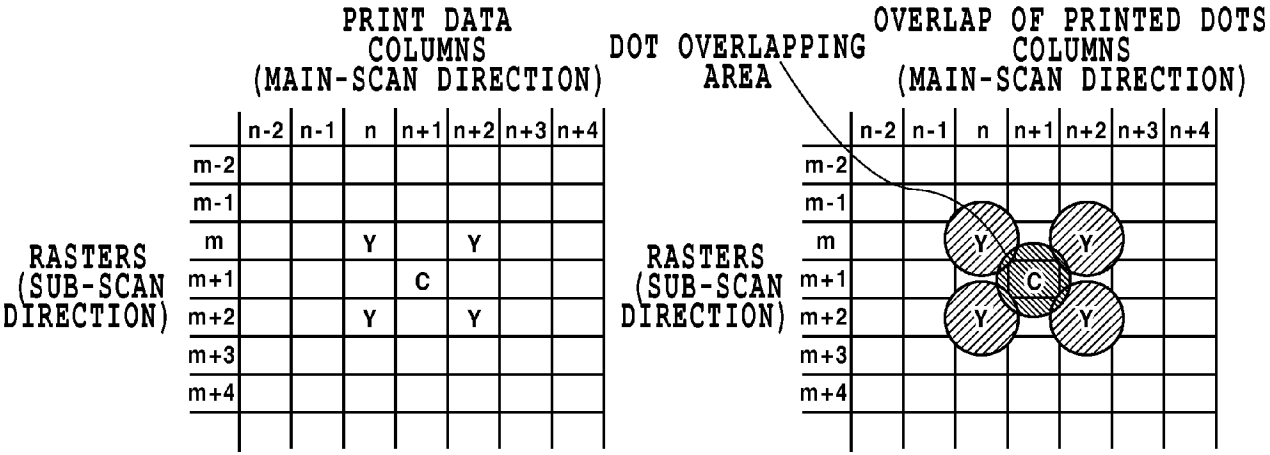
FIG.6C
FIG.6D

IMAGE DATA (YELLOW)
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | Y | Y | Y | | |
| m+1 | | | Y | Y | Y | | |
| m+2 | | | Y | Y | Y | | |
| m+3 | | | | | | | |
| m+4 | | | | | | | |

FIG.7A

PRELIMINARY EJECTION DATA
COLUMNS
(MAIN-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | | | | | |
| m+1 | | | | C | | | |
| m+2 | | | | | | | |
| m+3 | | | | | | | |
| m+4 | | | | | | | |

FIG.7B

PRINT DATA
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | y | y | y | | |
| m+1 | | | y | c | y | | |
| m+2 | | | y | y | y | | |
| m+3 | | | | | | | |
| m+4 | | | | | | | |

FIG.7C

DOT OVERLAPPING AREA

OVERLAP OF PRINTED DOTS
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | y | y | y | | |
| m+1 | | | y | C | y | | |
| m+2 | | | y | y | y | | |
| m+3 | | | | | | | |
| m+4 | | | | | | | |

FIG.7D

IMAGE DATA (YELLOW)
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | Y | Y | Y | | |
| m+1 | | | Y | Y | Y | | |
| m+2 | | | Y | Y | Y | | |
| m+3 | | | | | | | |
| m+4 | | | | | | | |

FIG.8A

PRELIMINARY EJECTION DATA
COLUMNS
(MAIN-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | | | | | |
| m+1 | | | | C | | | |
| m+2 | | | | | | | |
| m+3 | | | | | | | |
| m+4 | | | | | | | |

FIG.8B

PRINT DATA OF FIRST PASS
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | Y | | Y | | |
| m+1 | | | | C | | | |
| m+2 | | | Y | | Y | | |
| m+3 | | | | | | | |
| m+4 | | | | | | | |

FIG.8C

PRINT DATA OF SECOND PASS
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | | Y | | | |
| m+1 | | | Y | | Y | | |
| m+2 | | | | Y | | | |
| m+3 | | | | | | | |
| m+4 | | | | | | | |

FIG.8D

IMAGE DATA (YELLOW)
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | Y | Y | Y | | |
| m+1 | | | Y | Y | Y | | |
| m+2 | | | Y | Y | Y | | |
| m+3 | | | | | | | |
| m+4 | | | | | | | |

FIG.12A

PRELIMINARY EJECTION DATA
COLUMNS
(MAIN-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | | | | | |
| m+1 | | | | C | | | |
| m+2 | | | | | | | |
| m+3 | | | | | | | |
| m+4 | | | | | | | |

FIG.12B

PRINT DATA
COLUMNS
(MAIN-SCAN DIRECTION)

RASTERS (SUB-SCAN DIRECTION)

| | n-2 | n-1 | n | n+1 | n+2 | n+3 | n+4 |
|---|---|---|---|---|---|---|---|
| m-2 | | | | | | | |
| m-1 | | | | | | | |
| m | | | Y | Y | Y | | |
| m+1 | | | Y | YC | Y | | |
| m+2 | | | Y | Y | Y | | |
| m+3 | | | | | | | |
| m+4 | | | | | | | |

FIG.12C

DOT OVERLAPPING AREA (CYAN AND YELLOW DOTS)

OVERLAP OF PRINTED DOTS
COLUMNS
(MAIN-SCAN DIRECTION)

EXPANSION OF DOT DIAMETER

RASTERS (SUB-SCAN DIRECTION)

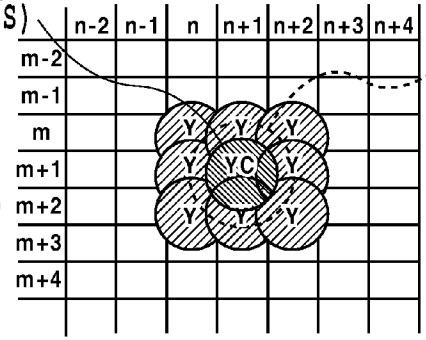

FIG.12D

INK JET PRINTING APPARATUS AND PRINTING METHOD

TECHNICAL FIELD

The present invention relates to an ink jet printing apparatus and a printing method.

BACKGROUND ART

In an ink jet printing apparatus, generally, not all print data use all the plurality of nozzles provided on a printing head, and there is a case where a particular nozzle is not used for a long time. Water or solvent in such a nozzle evaporates, and thus the viscosity thereof increases. As a result, in some cases, ink is not ejected properly from such a nozzle, even when a drive signal is applied to an element generating energy used for ejecting the ink. This causes a deflection of the ejecting direction, and allows only an insufficient amount of ink to be ejected, or in extreme cases, ink is not ejected at all (hereinafter, these poor conditions are called an ejection failure). As a result, a desired image cannot sometimes be obtained.

An operation called a preliminary ejection is performed as one of treatments for eliminating the factors causing the ejection failure and for restoring a favorable ink ejection performance of a printing head. In this operation, ink is ejected by driving an element generating energy used for ejecting the ink, for the purpose of refreshing the ink in a nozzle, in addition to the purpose of forming an image in a printing operation. In particular, this operation is aimed at ejecting, from a nozzle, ink in an inadequate condition to secure the ejection performance and printing quality when the partial evaporation of volatile constituents such as water or solvent contained in the ink results in the inadequate condition.

Conventionally, a certain arbitrarily chosen method has been used in order to perform the preliminary ejection. For example, the preliminary ejection is performed in a state where the printing head faces a cap provided outside a printing area of the printing head. In this case, however, the printing head is required to move away from the printing area, but this movement needs a longer time of suspending the printing operation. As a result, the throughput of printing decreases.

In contrast, there is a method in which the preliminary ejection operation is performed by ejecting thickened ink in nozzles directly onto a printing medium without suspending the printing operation (for example, Japanese Patent Application Laid-Open No. 6-40042 (1994) and Japanese Patent Application Laid-Open No. 55-139269 (1980)). In this preliminary ejection operation, ink is ejected onto a printing medium such as a sheet of paper. This preliminary ejection has an advantage of avoiding a decrease in the throughput of printing, since the preliminary ejection operation can be performed during the printing operation.

In this preliminary ejection operation, ink is ejected directly onto a printing medium on which an image is actually printed. Accordingly, when an ink dot with a certain size and a certain density is formed on the printing medium with the ink of the preliminary ejection, the ink dot may be noticeable, and may deteriorate the printing quality. There is a method to solve this problem by making the dot formed with the ink of the preliminary ejection less noticeable. To make the dot less noticeable, the ink is ejected onto an area with a high optical reflection density, such as a black letter, in the image.

Nevertheless, in the circumstance in which various kinds of printing are performed to meet the demands of users as the use of ink jet printing apparatuses is increasing, a printing image does not necessarily include an area with a high optical reflection density, such as a black letter. In this case, the preliminary ejection of ink has to be done onto a color image on a printing medium.

The inventors of the present invention, however, found that the printing quality is deteriorated in a case where the color image and the ink that is ejected preliminarily have a certain relationship. In addition, the present inventors also found that the deterioration in the printing quality is particularly remarkable in a case where a dot of low lightness is formed by preliminarily ejecting ink which presents relatively low lightness on a printing medium, such as a cyan ink, on an image area formed with ink which presents relatively high lightness on a printing medium, such as a yellow ink.

This finding will be explained by using FIGS. 12A to 12D. First, assume that there is a yellow (Y) ink image data covering an area extending from the coordinates n to n+2 in a main-scan direction and from the coordinates m to m+1 in a sub-scan direction, as shown in FIG. 12A. Then, assume that a cyan (C) ink is to be preliminarily ejected onto the set of coordinates (n+1, m+1), as shown in FIG. 12B. As a result, a cyan ink dot is formed in the set of coordinates (n+1, m+1) on the printing medium, overlapping a yellow ink dot, as shown in FIG. 12C. In this position, the dot has a green color that is a secondary color made by the yellow ink dot and the cyan ink dot.

However, a problem arises here. The problem is that the cyan ink dot, which is landed on the set of coordinates (n+1, m+1), expands widely (to an area circled with a dashed line), as shown in FIG. 12D. To be more precise, the cyan ink dot (hereinafter called "a later-landed dot") overlaps the yellow ink dot (hereinafter called "an earlier-landed dot"), and expands, thereby forming a dot with a large diameter. In other words, the later-landed cyan ink dot expands into areas of the yellow ink dots formed in other sets of coordinates surrounding the set of coordinates where the cyan ink dot is landed.

The lightness of the yellow area formed on the printing medium is high, and the area is light and bright to the human eye. For this reason, if the large dot of low lightness exists in the yellow area, the contrast between the large dot of low lightness and the yellow color background becomes very noticeable, and thus the visual detectability thereof is increased. This results in the deterioration in the printing quality.

This problem arises not only in the relationship between yellow and cyan, but also in a case where a dark color ink, such as a magenta ink or a black ink, is preliminarily ejected onto an image area formed with the yellow ink. In addition, nowadays, there is a printing apparatus using a light cyan ink and a light magenta ink. This problem also arises in a case where an ink of low lightness is preliminarily ejected onto an area printed with any of these light color inks. In other words, when an ink of low lightness is preliminarily ejected onto an image area formed of ink dots of high lightness, the dot of low lightness that is preliminarily ejected becomes very noticeable.

DISCLOSURE OF THE INVENTION

An object of the present invention is to solve the foregoing problem, that is, to make an ink dot formed by a preliminary ejection less noticeable, and to reduce the influence on the printing quality even in a case where an ink of low lightness is preliminarily ejected onto an image area of high lightness.

For this purpose, a first aspect of the present invention provides an ink jet printing apparatus which prints an image on a printing medium by ejecting inks having different lightness on the printing medium by using an ink jet printing head capable of ejecting the inks, and which can preliminarily eject the inks on the printing medium while printing the image, the ink jet printing apparatus comprising:

judgment means for judging whether or not, onto an area including a position where one ink is to be preliminarily ejected and the vicinity of the position, another ink of higher lightness than that of the one ink to be preliminarily ejected, is to be ejected; and ink-application-amount reduction means for performing a process of reducing the amount of the other ink applied for forming an image in the area in a case where an affirmative judgment is made by the judgment means.

A second aspect of the present invention provides an ink jet printing method which prints an image on a printing medium by ejecting inks having different lightness on the printing medium by using an ink jet printing head capable of ejecting the inks, and which can preliminarily eject the inks on the printing medium while printing the image, the ink jet printing method comprising the steps of:

judging whether or not, onto an area including a position where one ink is to be preliminarily ejected and the vicinity of the position, another ink of higher lightness than that of the one ink to be preliminarily ejected, is to be ejected; and ink-application-amount reduction means for performing a process of reducing the amount of the other ink applied for forming an image in the area in a case where an affirmative judgment is made by the judging step.

In the present invention, in a case where an ink of low lightness is preliminarily ejected onto a color image area of high lightness, the amount of the color ink to be applied for printing the area is reduced. This reduces an area where the ink dot formed by the preliminary ejection overlaps the light color image area. Thus, it is possible to make the ink dot formed by the preliminary ejection less noticeable, and to reduce the influence on the printing quality.

Further features of the present invention will become apparent from the following description of exemplary embodiments (with reference to the attached drawings).

BRIEF DESCRIPTION OF THE DRAWING

FIGS. 4A to 4D are explanatory diagrams for explaining an ink-application-amount reduction process of a first embodiment;

FIGS. 5A to 5D are explanatory diagrams for explaining an ink-application-amount reduction process of a second embodiment;

FIGS. 6A to 6D are explanatory diagrams for explaining an ink-application-amount reduction process of a third embodiment;

FIGS. 7A to 7D are explanatory diagrams for explaining an ink-application-amount reduction process of a fourth embodiment;

FIGS. 8A to 8D are explanatory diagrams for explaining an ink-application-amount reduction process of a fifth embodiment;

FIGS. 12A to 12D are explanatory diagrams for explaining a conventional problem caused by preliminary ejection of an ink onto a printing medium.

BEST MODE FOR CARRYING OUT THE INVENTION

Figure 1:
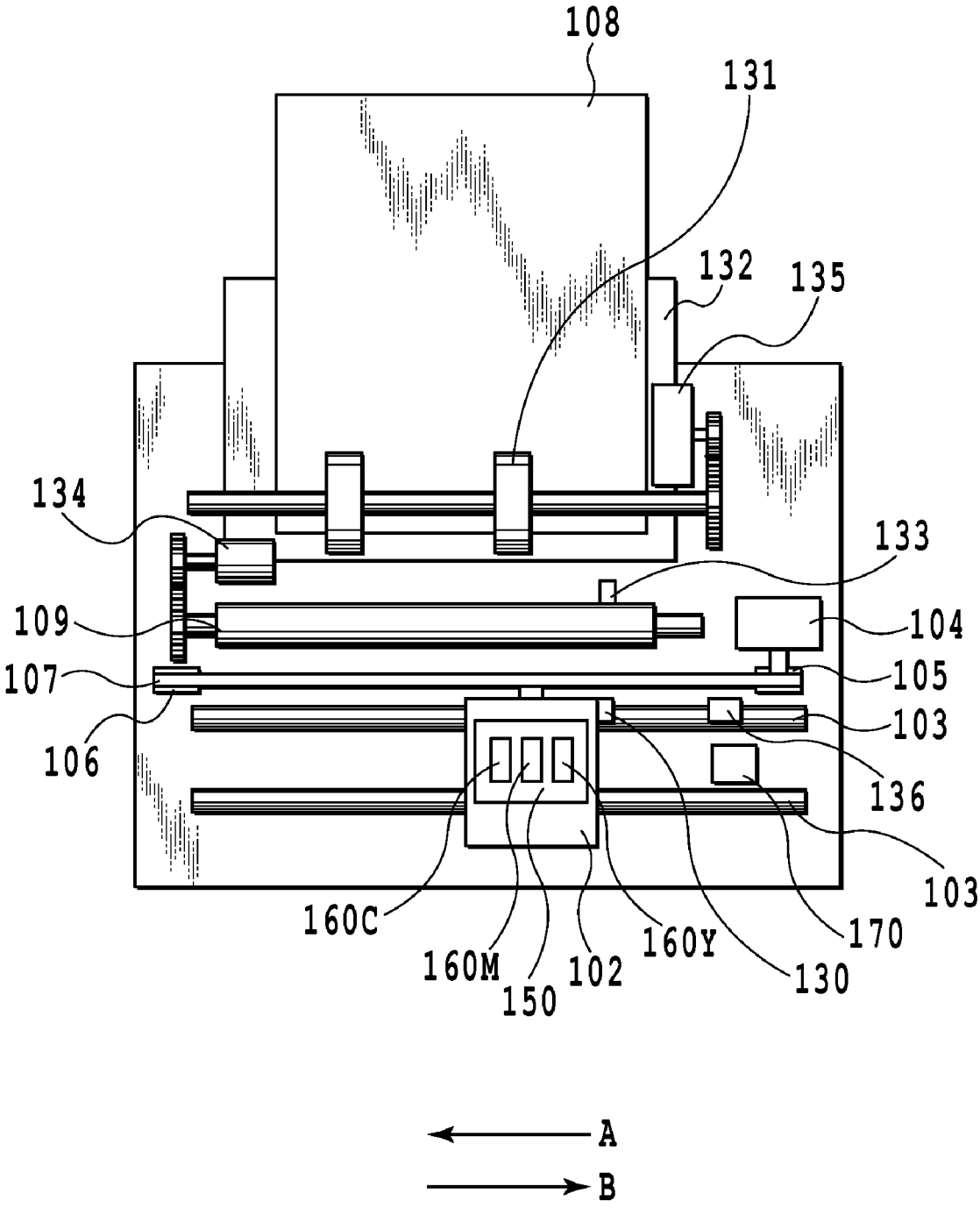
FIG. 1 is a schematic plan view showing an example of an ink jet printing apparatus to which the present invention can be applied.

Descriptions will be given of the present invention below by referring to the drawings.

1. Configuration Example of Ink Jet Printing Apparatus

FIG. 1 is a schematic plan view showing an example of an ink jet printing apparatus to which the present invention can be applied. This printing apparatus includes a carriage 102 for positioning a printing head 150. The printing head 150 is exchangeably mounted on the carriage 102. The carriage 102 is provided with an electric connection portion for transmitting a drive signal or the like to each of ejection portions via each of external signal connecting terminals located on the printing head 150.

The carriage 102 is supported as being capable of reciprocating in A direction and in B direction along guide shafts 103, which are provided to an apparatus body, and which extend in a main-scan direction. The carriage 102 is driven by a main scan motor (a carriage motor) 104 via a transmission mechanism including a motor pulley 105, a driven pulley 106, a timing belt 107 and the like. In addition, the position and the movement of the carriage 102 are also controlled by the main scan motor 104 via the transmission mechanism. Moreover, the carriage 102 is provided with a home position sensor 130. When the home position sensor 130 on the carriage 102 passes by the position of a shielding plate 136, the home position is detected.

A pick-up roller 131 is driven to rotate by a sheet feed motor 135 via a gear, and thereby printing media 108 such as a printing paper sheet or a thin plastic sheet are fed from an automatic sheet feeder (ASF) 132, separately, one by one. Thereafter, the printing medium 108 is conveyed (sub-scanned) by the rotation of a conveyance roller 109 driven by a conveyance motor 134 via gears, and thus passes through a position (a printing area) opposite to a face of the printing head 150 where nozzles (ejection ports) are formed (an ejection port forming face). When the printing medium 108 passes by a paper end sensor 133, a judgment is made as to whether or not the printing medium 108 is fed, and a determination is made on the position of the leading edge of the printing medium during sheet feeding. The paper end sensor 133 is used to detect where the rear end of a printing medium 108 actually is positioned, and thus the paper end sensor 133 is also used for finally determining the current printing position according to the actual position of the rear end.

The back surface of a printing medium 108 is supported by a platen (not illustrated), and thus the printing medium 108 forms the flat surface to be printed at the printing area. In this case, the printing head 150 mounted on the carriage 102 is held with the ejection port forming face downwardly protruding from the carriage 102 and being parallel with the printing medium 108. The printing head 150 is caused to perform the main scanning in the printing area.

The printing head 150 is mounted on the carriage 102 in a way that the main-scan direction of the carriage 102 crosses the direction in which nozzles in each of nozzle columns are arranged (for example, the sub-scan direction). The printing head 150 ejects ink from these nozzle columns during the main scanning process, and thus make a print with a swath equivalent to the range where the nozzles are arranged.

A recovery system unit 170 is provided near the home position. The recovery system unit 170 includes a cap member and a lifting mechanism. The cap member is used for capping the ejection port forming face of the printing head, and is formed of an elastic material, such as rubber. In addition, suction means is connected to the cap member, and is used for preventing the nozzles from clogging by forcibly sucking ink from the nozzles. Moreover, the recovery system unit 170 may include a wiping member with which the ejection port forming face is wiped.

A plurality of ink tanks are mounted on the printing head 150, and can be individually attached to/detached from the printing head 150. The number of ink tanks corresponds to the number of ink colors used in the printing apparatus. The figure illustrates a printing head, on which ink tanks 160Y, 160M and 160C containing respectively a yellow color ink, a magenta color ink and a cyan color ink, are mounted.

Figure 2B:
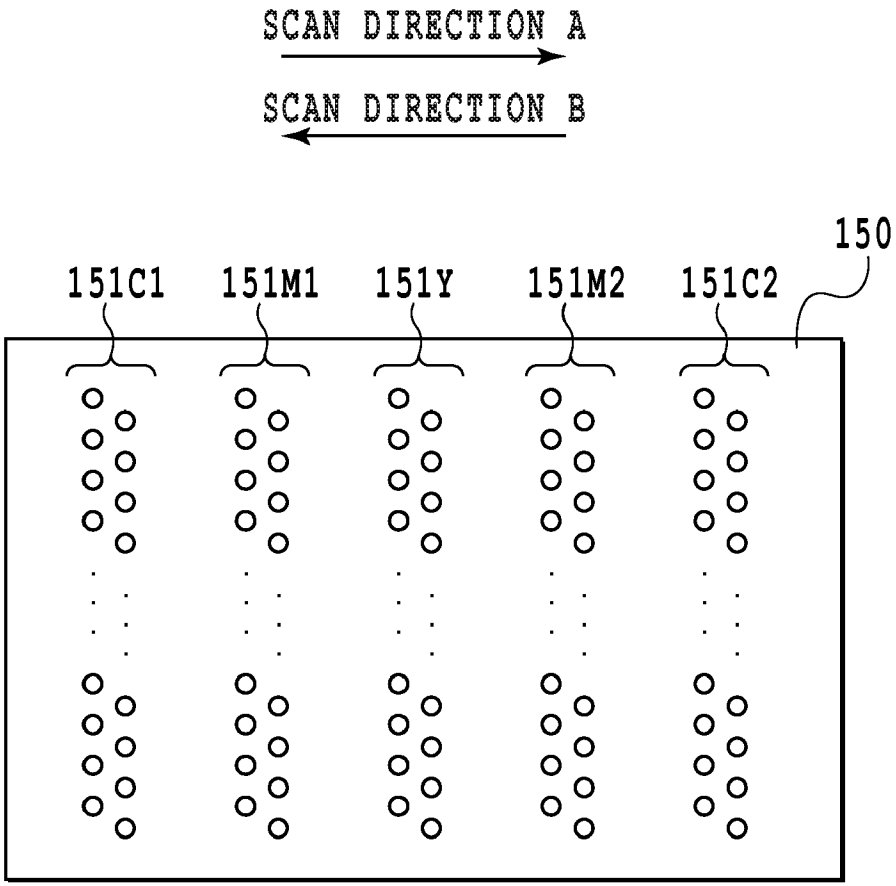
FIGS. 2A and 2B are schematic elevation views showing two examples of an array structure of nozzle columns provided to a printing head applicable to the apparatus in FIG. 1.
Figure 2A:
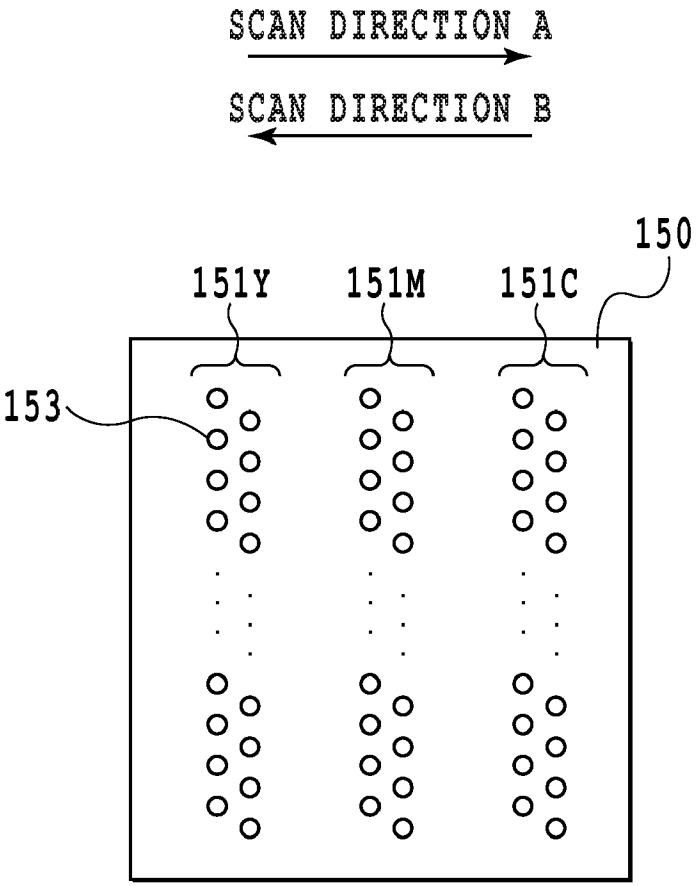

FIGS. 2A and 2B shows two examples of an array structure of the nozzle columns provided to the printing head 150, and, in these figures, the printing head 150 is viewed from the ejection port forming face side.

Firstly, FIG. 2A shows an array structure formed by arraying, in parallel, nozzle columns 151C, 151M and 151Y respectively for a cyan ink, a magenta ink and a yellow ink. In each nozzle column, two column components of nozzles 153 are disposed. Nozzles of one the two column components line up as shifting half an arranging pitch from those of the other column component in directions orthogonal to the main-scan directions (direction A and direction B), that is, the sub-scan directions. Secondly, FIG. 2B shows an array structure in which nozzle columns 151C1 and 151C2 for cyan inks, and nozzle columns 151M1 and 151M2 for magenta inks are symmetrically arranged about a nozzle column 151Y for a yellow ink.

Figure 3:
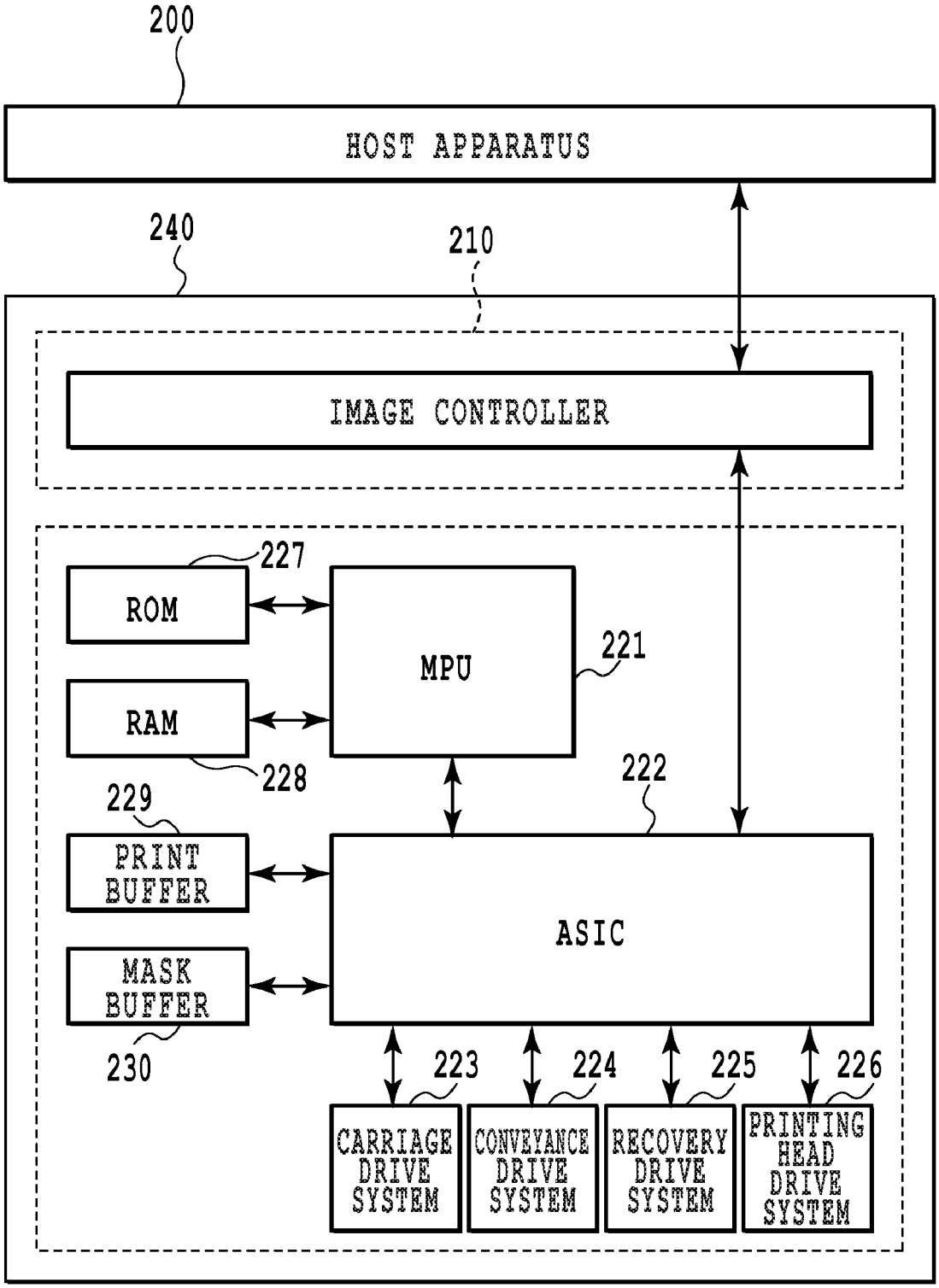
FIG. 3 is a block diagram showing a configuration example of a control system of the printing apparatus in FIG. 1.

FIG. 3 shows a configuration example of a control system of the printing apparatus in FIG. 1. Here, reference numeral 200 denotes a host apparatus such as a computer, and reference numeral 240 denotes the printing apparatus.

Reference numeral 221 denotes an MPU which controls the entire printing apparatus. Reference numeral 227 denotes a ROM storing programs corresponding to procedures of processes executed by the MPU, and other kinds of fixed data. Reference numeral 228 denotes a RAM having a storage region used for operation by the MPU 221 in the course of control.

Reference numeral 222 denotes an ASIC (Application Specific Integrated Circuit) which controls each of mechanical sections such as a carriage drive system 223, a conveyance drive system 224, a recovery drive system 225 and a printing head drive system 226. The carriage drive system 223 includes the carriage motor 104 and the like for causing the carriage 102 to perform the scanning. The conveyance drive system 224 includes motors 134 and 135, and the like for feeding and conveying printing media. The recovery drive system 225 includes the lifting mechanism for moving the cap member of the recovery system unit 170 up and down, a drive mechanism of the suction means and of the wiping member, and the like. The printing head drive system 226 includes a driver and the like, which drives printing elements provided to the printing head 150 according to image data representing an image to be printed, and according to data for the preliminary ejection.

Reference numeral 210 denotes an image controller that compares image data transmitted from the host apparatus 200 with data for the preliminary ejection, and that performs an ink-ejection-amount reduction process that is applied to each embodiment described later. Here, the ASIC 222 judges whether or not it is necessary to perform the preliminary ejection. Reference numeral 229 denotes a print buffer used for arranging a predetermined amount of drive data (print data) for the printing head 150. The drive data is defined by the image data (the image data causing the ink-application amount to be reduced if necessary) and the data for the preliminary ejection. Reference numeral 230 denotes a mask buffer in which mask data is arranged when so-called multi-pass printing is performed. In the multi-pass printing, a print on one area of a printing medium is completed by plural times of scanning, and the mask data defines how to thin the print data in each scanning.

2. Various Types of Embodiments of Ink-Application-Amount Reduction Process

Descriptions will be given of various types of embodiments of the ink-application-amount reduction process. Hereinafter, the descriptions use a cyan ink as an example of an ink with which a color of low lightness has on a printing medium, and a yellow ink as an example of an ink with which a color of high lightness has on a printing medium. This, however, is just an example, and the ink-application-amount reduction process can be widely used for any case where an ink with low lightness is preliminarily ejected onto an image area with high lightness, and thereby making the preliminarily-ejected dot with low lightness very noticeable.

2.1 First Embodiment

In this Embodiment, in a case where a yellow ink dot exists in a position onto which a cyan ink is to be preliminarily ejected, the amount of yellow ink to be applied is reduced by deleting a piece of image data for forming the yellow ink dot.

FIGS. 4A to 4D are explanatory diagrams for this embodiment.

As shown in FIG. 4A, firstly, assume that there is a yellow (Y) ink image data covering an area extending from the coordinates n to n+2 in the main-scan direction and from the coordinates m to m+1 in a sub-scan direction. Then, assume that a cyan (C) ink is to be preliminarily ejected into the set of coordinates (n+1, m+1) inside the above area, as shown in FIG. 4B.

In this case, in this embodiment, print data is formed by deleting a piece of data for forming the yellow ink dot in the set of coordinates (n+1, m+1) so that only the cyan ink dot is formed in the point, as shown in FIG. 4C. As a result, the cyan ink dot is landed on the set of coordinates (n+1, m+1) where no yellow ink dot exists, as shown in FIG. 4D. Thereby, the cyan ink dot does not expand widely. Specifically, only the circumferential part of the cyan ink dot slightly overlaps the surrounding yellow ink dots. Thus, the overlapping area of the area of low lightness and the yellow area becomes remarkably smaller than that of the conventional example explained by using FIG. 12. This makes the cyan ink dot preliminarily ejected onto the printing medium less noticeable, and thus the deterioration in the printing quality can be checked.

2.2 Second Embodiment

In this Embodiment, even in a case where a yellow ink dot exists not in a position where a cyan ink is to be preliminarily ejected, but around the position, the amount of yellow ink to be applied is reduced by thinning image data for forming the surrounding yellow ink dots.

FIGS. 5A to 5D are explanatory diagrams for this embodiment.

As shown in FIG. 5A, firstly, assume that there is a yellow (Y) ink image data, except for the set of coordinates (n+1, m+1), covering an area extending from the coordinates n to n+2 in a main-scan direction and from the coordinates m to m+1 in a sub-scan direction. Then, assume that a cyan (C) ink is to be preliminarily ejected into the set of coordinates (n+1, m+1) inside the above area, as shown in FIG. 5B.

In this embodiment, the pieces of data deleted in this case are those for forming the dots in the sets of coordinates (n+1, m) and (n+1, m+2), both of which are adjacent to the preliminary ejection coordinates only in the sub-scan direction, as shown in FIG. 5C. Also deleted are the pieces of data for the dots on the sets of coordinates (n, m+1) and (n+2, m+1), both of which are adjacent to the preliminary ejection coordinates only in the main-scan direction, also as shown in FIG. 5C. Then, as shown in FIG. 5D, the circumferential part of the cyan ink dot, which is landed on the set of coordinates (n+1, m+1), slightly overlaps only the yellow ink dots located in the diagonal directions. Thus, the area of low lightness becomes remarkably small. This makes the cyan ink dot preliminarily ejected onto the printing medium less noticeable, and the deterioration in the printing quality can be checked.

Note that, obviously, the way of thinning the data for the yellow dot formation around the point of preliminary ejection can be defined appropriately. The thinning can be done in any way as long as the area of low lightness can effectively be reduced thereby. For example, the pieces of data for forming the yellow ink dots located in the diagonal directions may be deleted. This can be similarly applied to the next embodiment and a fifth embodiment.

2.3 Third Embodiment

In this Embodiment, in a case where a yellow ink dot exists in a position where a cyan ink is to be preliminarily ejected, and where yellow ink dots also exist around the position, the amount of yellow ink to be applied is reduced by thinning image data for forming the yellow ink dots.

FIGS. 6A to 6D are explanatory diagrams for this embodiment.

As shown in FIG. 6A, first, assume that there is a yellow (Y) ink image data covering an area extending from the coordinates n to n+2 in a main-scan direction and from the coordinates m to m+1 in a sub-scan direction. Then, assume that a cyan (C) ink is to be preliminarily ejected into the set of coordinates (n+1, m+1) inside the above area, as shown in FIG. 6B.

In this embodiment, the pieces of data deleted in this case are those for forming the yellow ink dots in the sets of coordinates (n+1, m), (n+1, m+2), (n, m+1) and (n+2, m+1) in addition to the set of coordinates (n+1, m+1) of the preliminary ejection position, as shown in FIG. 6C. Then, as shown in FIG. 6D, the circumferential part of the cyan ink dot, which is landed on the set of coordinates (n+1, m+1), slightly overlaps only the yellow ink dots located in the diagonal directions. Thus, the area of low lightness becomes remarkably small. This makes the cyan ink dot preliminarily ejected onto the printing medium less noticeable, and the deterioration in the printing quality can be checked.

Note that, if the area of the cyan dot overlapping the area of the yellow dots can be reduced effectively, it is also possible to make only the data for the yellow dots around the set of coordinates (n+1, m+1) to be thinned.

2.4 Forth Embodiment

In the foregoing embodiments, the application amount of the yellow ink is reduced by thinning an image data, and thus the area of the low lightness is reduced. In contrast, this embodiment additionally employs a process in which the yellow-ink application-amount, itself, for forming the yellow dots is reduced, in a case where a yellow ink dot exists in a position where a cyan ink is to be preliminarily ejected, and where yellow ink dots also exist around the position. To be more precise, in this embodiment, apiece of data for forming the yellow ink dot in the preliminary ejection position is deleted, and the amount of the yellow ink to be applied for forming the surrounding yellow ink dots is reduced. As a result, the surrounding yellow ink dots are formed with a smaller diameter.

FIGS. 7A to 7D are explanatory diagrams for this embodiment.

As shown in FIG. 7A, firstly, assume that there is a yellow (Y) ink image data covering an area extending from the coordinates n to n+2 in a main-scan direction and from the coordinates m to m+1 in a sub-scan direction. Then, assume that a cyan (C) ink is to be preliminarily ejected into the set of coordinates (n+1, m+1) inside the area, as shown in FIG. 7B.

In this embodiment, to begin with, a piece of data for forming the yellow ink dot in the set of coordinates (n+1, m+1) of the preliminary ejection position is deleted in this case, as shown in FIG. 7C. In addition, together with this operation, the amount of yellow ink to be applied to the surrounding sets of coordinates is reduced (shown by using the lower case letter y). Then, as shown in FIG. 7D, a cyan ink dot is landed on the set of coordinates (n+1, m+1) in a state where no yellow ink dot exists in the position. Hence, the cyan ink dot does not expand widely. In addition, the yellow ink dots each with a smaller diameter exist around the cyan ink dot. Accordingly, an overlapping area of the circumferential part of the cyan ink dot and the surrounding yellow ink dots is reduced, and thus an area of the low lightness becomes remarkably small, as a whole. This makes the cyan ink dot preliminarily ejected onto the printing medium less noticeable, and the deterioration in the printing quality can be checked.

Note that, although the piece of data for forming the yellow ink dot in the preliminary ejection position is deleted in the foregoing descriptions, it is also possible only to reduce the size of the yellow dot in the preliminary ejection position like the surrounding yellow dots without deleting the corresponding piece of data.

Note also that, in this embodiment, the amount of ink to be applied for forming the surrounding yellow ink dots is reduced. This reduction is exactly the reduction of the amount of ejected ink. For this purpose, various types of methods can be employed. For example, it is possible to employ a method in which the different ejection amounts are obtained by changing electrical energy (a drive voltage and/or a drive pulse width) applied to an element that generates energy used for ejecting ink. Alternatively, it is also possible to employ a method in which the different ejection amounts are obtained by employing a printing head provided with two elements for one nozzle, and thus by changing the number of elements, that is, between one and two, to be driven. Still alternatively, a method can also be employed in which nozzles ejecting the different amounts of ink are selectively driven.

2.5 Fifth Embodiment

In this embodiment, in a case where a yellow ink dot exists in a position where a cyan ink is to be preliminarily ejected, and where yellow ink dots also exist around the position, the yellow ink application amount is reduced by firstly thinning an image data for forming the yellow ink dots. In addition, after the preliminary ejection, the yellow ink dots corresponding to some pieces of image data that have been culled previously are formed. In other words, in the printing area of the yellow ink, a print is made by scanning twice (in two passes).

FIGS. 8A to 8D are explanatory diagrams for this embodiment.

As shown in FIG. 8A, firstly, assume that there is a yellow (Y) ink image data covering an area extending from the coordinates n to n+2 in a main-scan direction and from the coordinates m to m+1 in a sub-scan direction. Then, assume that a cyan (C) ink is to be preliminarily ejected into the set of coordinates (n+1, m+1) inside the above area, as shown in FIG. 8B.

In this embodiment, firstly, in addition to a piece of data for forming the yellow ink dot in the set of coordinates (n+1, m+1) of the preliminary ejection position, excluded are those for forming the yellow ink dots in the adjacent sets of coordinates only in the sub-scan direction and the yellow ink dots in the adjacent sets of coordinates only in the main-scan direction in this case. Thus, the print data for the first pass is formed. According to this data, the yellow ink dots in the coordinates of the preliminary ejection position and in the adjacent sets of coordinates only in the main-scan and sub-scan directions are not formed in the first pass.

Subsequently, the print data for the second pass is formed by using the pieces of data which are for forming the yellow ink dots in the adjacent sets of coordinates, and which have been excluded from the print data for the first pass as shown in FIG. 8D. According to this print data, the yellow ink dots in the positions corresponding to the pieces of data having been culled by the thinning for the first pass are to be formed in the second pass. Thus, the pieces of yellow image data are complemented. Accordingly, the yellow image data can be restored to almost the original image data before the thinning.

Figure 9A:
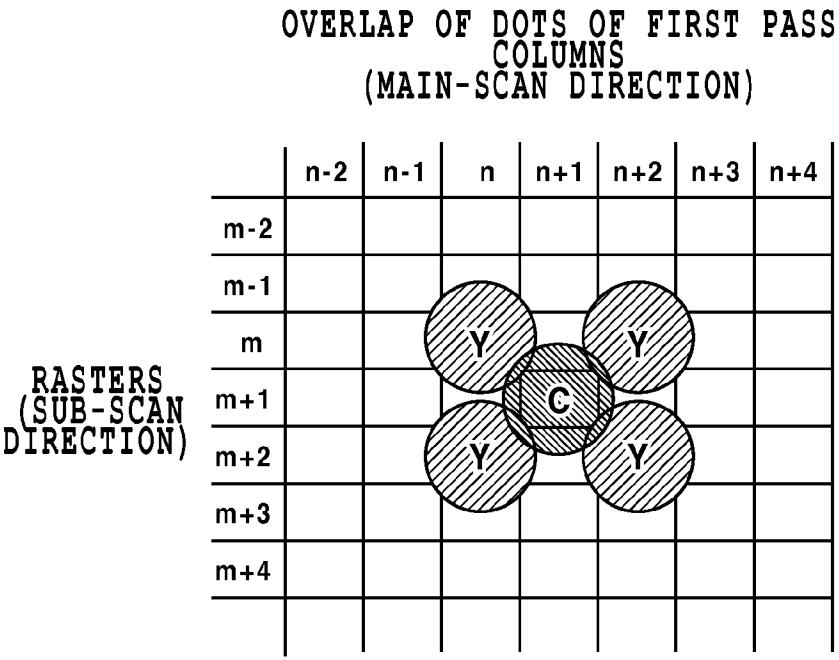
FIGS. 9A and 9B are explanatory diagrams for explaining the ink-application-amount reduction process of the fifth embodiment.
Figure 9B:
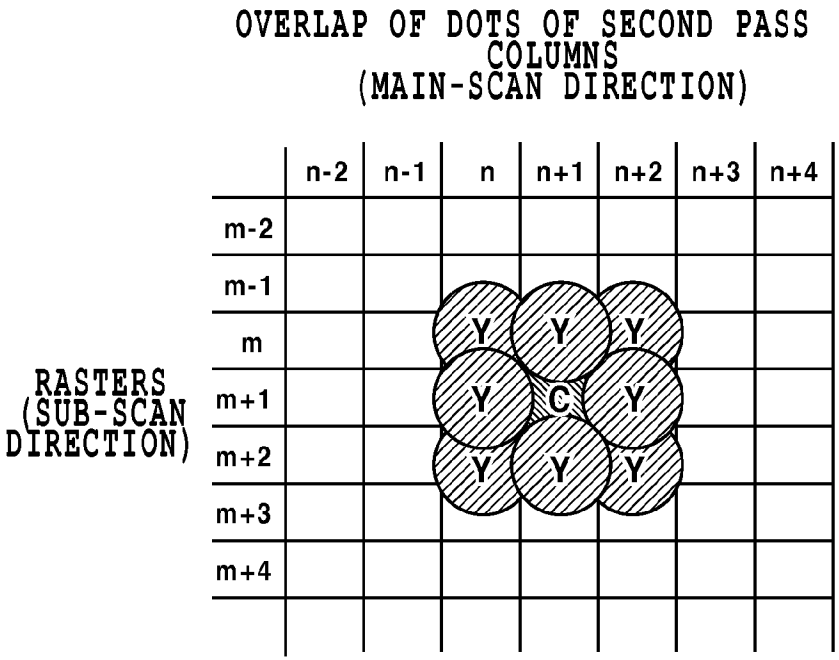

FIG. 9A shows a dot formation state upon completion of the first pass, and FIG. 9B shows a dot formation state upon completion of the second pass.

In the state that FIG. 9A shows, the cyan dot overlaps the yellow ink dots formed as being thinned. The circumferential part of the cyan ink dot slightly overlaps only the yellow ink dots in the diagonal directions. However, there is a case where the exclusion of some of yellow ink dots leads to a shortage of the yellow ink dots as a whole, and thereby losing the color balance. On the other hand, FIG. 9B shows the state where the dots after the second pass overlap one another. As shown in FIG. 9B, by forming, in the second pass, the yellow ink dots that have been excluded in the first pass, the application rate of yellow ink is increased up, approximately to the possible application rate before the thinning of yellow ink dots. As a result, a favorable color balance can be obtained. In other words, it is possible to reproduce the original image as close as possible, while making the cyan ink dot preliminarily ejected onto the printing medium less noticeable in this embodiment. Thus, an image with an even higher quality can be formed.

Note that this kind of complementation for the culled dots may be performed in a pass different from the pass in which the preliminary ejection is performed, as in this embodiment, or alternatively, the complementation may be performed in any another way. For example, assume that a printing head provided with a column of cyan ink nozzles between two columns of yellow ink nozzles in the main-scan directions. In this case, in a certain scan (pass), the yellow ink nozzles in the preceding position may form dots while culling some dots, and the yellow ink nozzles in the following position may form dots in complementation for the culled dots.

3. Procedure of Ink-Application-Amount Reduction Process

The process in each of the embodiments described above can be performed by using the configuration shown in FIGS. 1 to 3 according to, for example, the following procedure.

Figure 10:
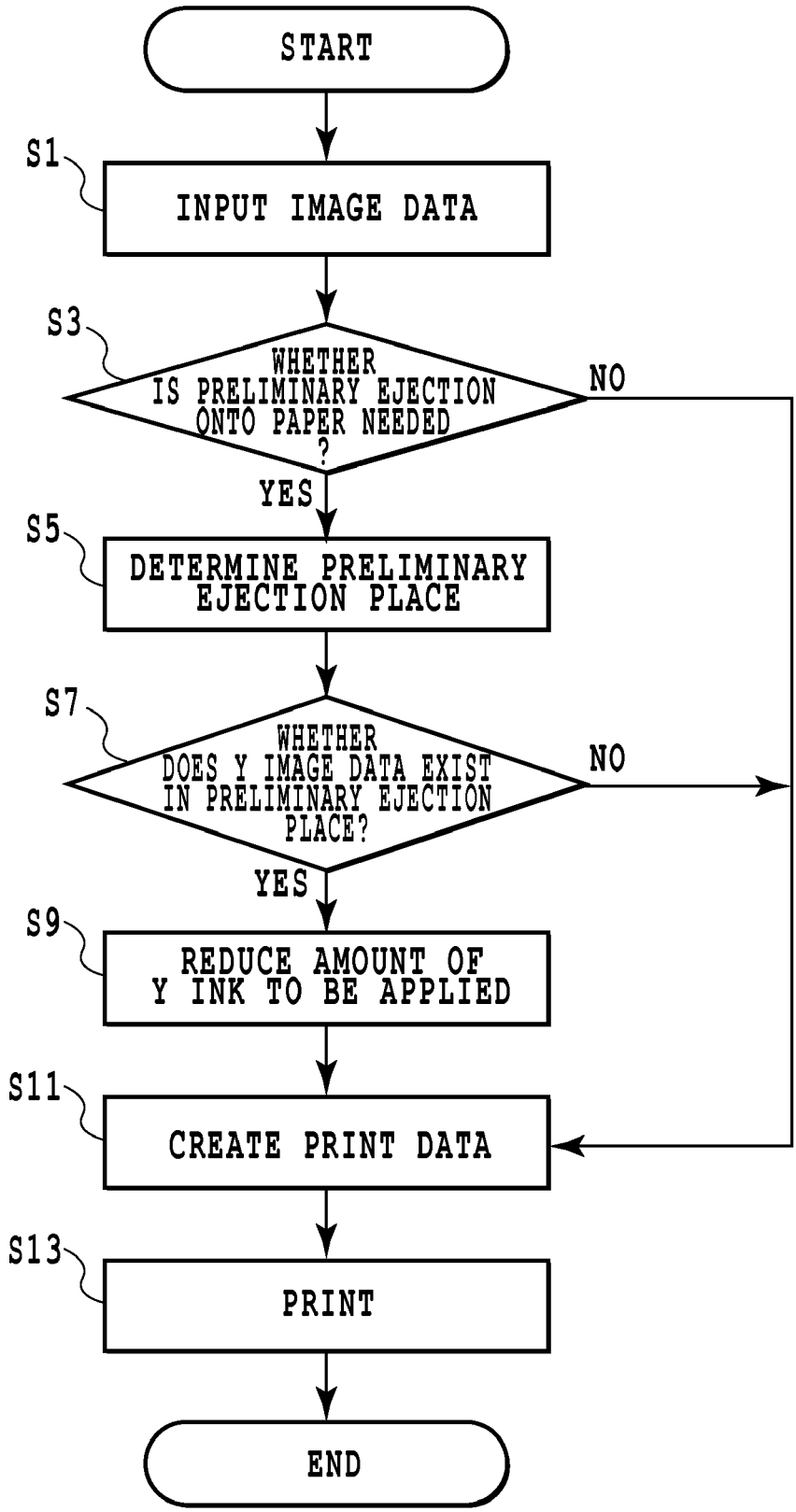
FIG. 10 is a flow chart showing an example of the ink-application-amount reduction process.

FIG. 10 shows an example of the procedure.

In this procedure, firstly, once an image data is inputted (step S1), a judgment as to whether or not each of the cyan ink nozzles needs a preliminary ejection of the cyan ink onto a printing medium (paper sheet) is carried out, according to the period of time when the nozzle has not been used and the frequency in use (step S3). When a negative judgment is made, the print data is formed on the basis of the image data (step S11) without any change, and the printing is performed (step S13). On the other hand, when an affirmative judgment is made, the nozzles that are judged as needing the preliminary ejection are set to prepare for preliminary ejection of the cyan ink in dispersed positions on the printing medium (step S5). Then, a judgment as to whether each of the preliminary ejection positions thus determined is in a yellow image area is carried out according to the image data (step S7). Precisely, a judgment as to whether a yellow dot exists in any of the preliminary ejection position and the positions adjacent to the preliminary ejection position is carried out. Here, in a case where an affirmative judgment is made, a yellow-ink-application-amount reduction process (setting for the thinning of data and/or the reduction of the ejection amount: step S9) as in the case of the embodiments described above is performed. Subsequently, on the basis of the thus created data on the preliminary ejection of the cyan ink and image data causing the yellow-ink-application-amount to be reduced, the print data is finally created (step S11). Then, the printing is performed (step S13).

Note that the judgment in step S7 is not limited to the foregoing method. For example, step S7 may employ the following method. Firstly, a judgment is made as to whether or not the yellow ink dots exist in both of the preliminary ejection position and any of the adjacent positions. Then, only in a case where the yellow dots exist in both of the positions, an affirmative judgment can be made (going to step S9), Another method as follows may be adopted. Firstly, a judgment is made as to whether or not the yellow dots exist within a predetermined area including the preliminary ejection position and the vicinity of the adjacent positions. Then, only in a case where the yellow dots exist within the predetermined area, an affirmative judgment can be made (going to step S9). When the yellow dots are not formed on the preliminary ejection position or in the adjacent positions, but are formed in the vicinity of such positions, there is a possibility that the yellow ink forming the dots may flow into the preliminary ejection position. For this reason, it is effective to judge whether or not the yellow dots exist within a relatively wide predetermined area equivalent to the vicinity of the preliminary ejection position.

Figure 11:
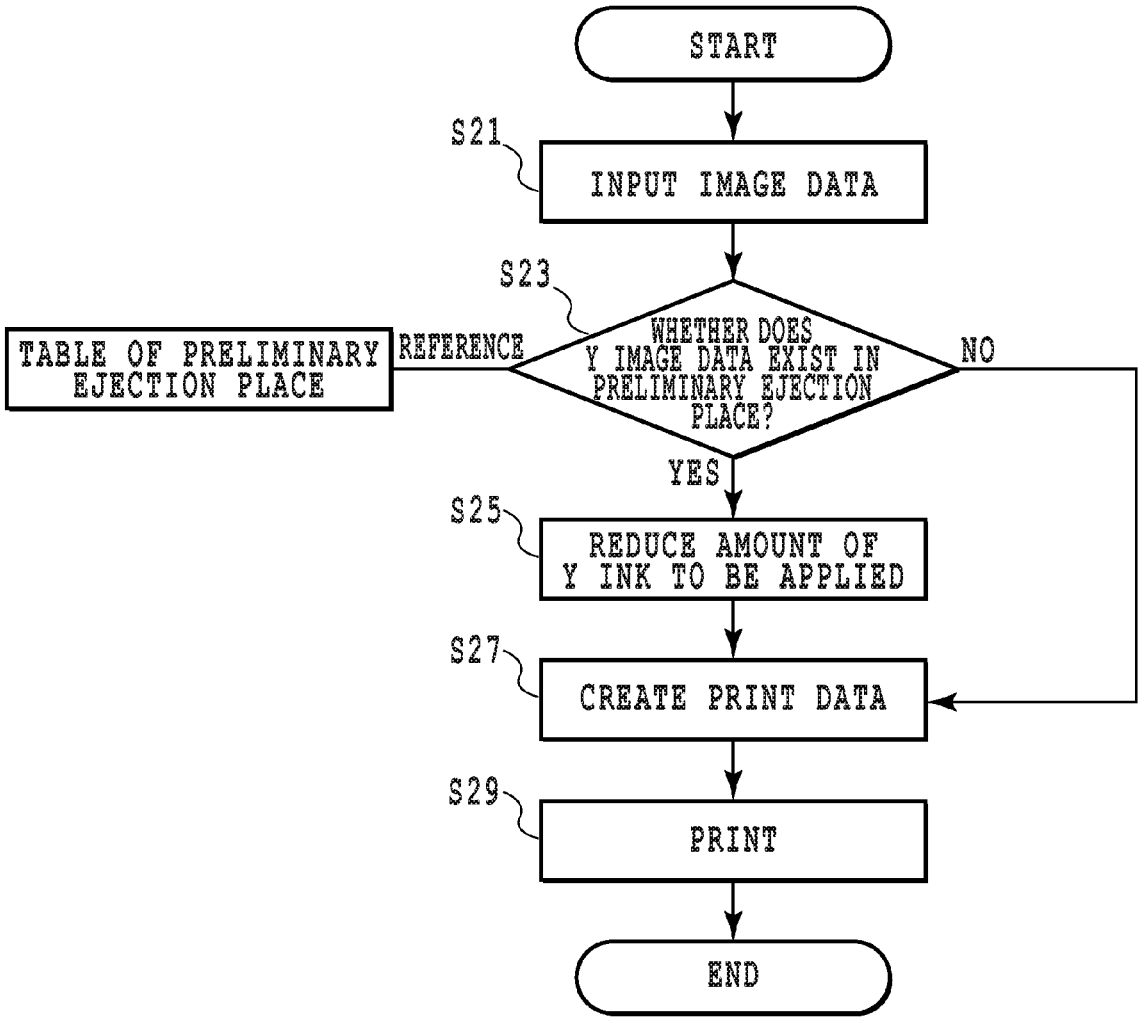
FIG. 11 is a flow chart showing another example of the ink-application-amount reduction process.

FIG. 11 shows another example of the procedure of the ink-application-amount reduction process.

In this procedure, once an image data is inputted (step S21), a judgment whether or not each of the preliminary ejection positions is in a yellow image area is carried out, according to the image data while referring to a content of a table defining the preliminary ejection positions for cyan ink nozzles (step 23). Here, when a negative judgment is made, the print data is created on the basis of the image data (step S27) without any change, and the printing is performed (step S29). On the other hand, when an affirmative judgment is made, a yellow-ink-application-amount reduction process (setting for the thinning of data and/or the reduction of the ejection amount: step S25) as in the case of the embodiments described above is performed. Subsequently, on the basis of the data on the ejection of the cyan ink and image data causing the yellow-ink-application-amount to be reduced, the print data is finally created (step S27). Then, the printing is performed (step S29).

In the procedure in FIG. 10, the necessity of the preliminary ejection is detected by judging whether or not, for example, the period of time when each nozzle is not in use exceeds a predetermined period of time as for each of the cyan ink nozzles. On this basis, the yellow-ink-application-amount reduction process is appropriately performed. In contrast, in the procedure in FIG. 11, on the assumption that the nozzles uniformly perform the preliminary ejection regardless of whether each of the nozzles is left not in use for more than a predetermined period of time, the yellow-ink-application-amount reduction process is appropriately performed.

The procedure in FIG. 10 requires a relatively complicated control. The procedure in FIG. 10, however, can make the amount of the preliminary ejection minimum necessary, since the necessity of the preliminary ejection is judged. Meanwhile, the procedure in FIG. 11 makes the amount of the preliminary ejection larger, but can make the control simple, since even a nozzle that has ejected ink in the image printing just before the current printing is uniformly caused to perform the preliminary ejection. Which of the procedures to be employed may be determined in response to the requirement of the system or the like. In addition, another kind of procedure for the ink-application-amount reduction process may be employed.

4. Others

In a case where the printing head shown in FIG. 2A is used, whichever of the above-mentioned processes and procedures for reducing the ink-application amount are employed, it is possible not to perform the ink-application-amount reduction process for the image data whose image is formed by the printing head in the main scanning in direction A. In other words, the ink-application-amount reduction process may be performed only when the printing head forms the image of the image data in the main scanning in direction B.

The following is the reason for this. In the main scanning of the printing head having the configuration shown in FIG. 2A in direction A, the nozzle column of the cyan ink ejects the ink before the nozzle column of the yellow ink ejects the ink. As a result, a yellow ink dot can overlap a cyan ink dot that has been preliminarily ejected. As described above, coloring matters in the ink applied later do not penetrate the printing medium in the position where the ink is applied, but expand along the surface of the printing medium. In this case, what expands is a yellow ink dot. In other words, a dot of low lightness with a large diameter is not formed in an area of high lightness. If such a dot of low lightness is formed in such an area, the resultant contrast will be very noticeable. In this way, the visual detectability is not increased in this case.

For the similar reason, in a case where the printing head having the configuration shown in FIG. 2B is used, the yellow-ink-application-amount reduction process may be carried out only for an area corresponding to a position where the following nozzle column 151C1 of the cyan ink is to perform the preliminary ejection in the main scanning of the printing head in direction A. Meanwhile, in the main scan in direction B, the yellow ink-application-amount reduction process may be performed only for an area corresponding to a position where the following nozzle column 151C2 of the cyan ink is to perform the preliminary ejection.

In addition, each of the foregoing embodiments illustrates the process of preliminary ejection of the cyan ink onto the image area formed with the yellow ink. Nevertheless, this is only an example, and the present invention can be widely applied to a case where an ink of low lightness is preliminarily ejected on an image area of high lightness, thereby forming a noticeable ink dot of low lightness. Precisely, in addition to the yellow ink, a light cyan ink and a light magenta ink are examples of the ink forming an area of high lightness. On the other hand, in addition to the cyan ink, a magenta ink and a black ink are examples of the ink forming a noticeable portion of low lightness.

Moreover, in the foregoing embodiments, the targets of the process of reducing the ink-application amount, by thinning the image data and/or by reducing the ejection amount, are only the dots in the preliminary ejection position and the adjacent positions thereto. However, in a case where a dot formed with a preliminarily ejected ink goes beyond an area of the adjacent surrounding dots, the process of reducing the ink-application amount may be performed for a certain predetermined area around the preliminary ejection position. This can be effectively applied to a case where, for example, a black ink is preliminarily ejected by using a printing head that ejects a larger amount of black ink to form a dot with a larger diameter.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-356313, filed Dec. 9, 2005, which is hereby incorporated by reference herein its entirety.

The invention claimed is:

1. An ink jet printing apparatus which prints an image on a printing medium by ejecting inks having different lightness on the printing medium by using an ink jet printing head capable of ejecting the inks, and which can preliminarily eject the inks on the printing medium while printing the image, the ink jet printing apparatus comprising:

judgment means for judging whether or not, onto an area including a position where one ink is to be preliminarily ejected and the vicinity of the position, another ink of higher lightness than that of the one ink to be preliminarily ejected is to be ejected; and ink-application-amount reduction means for performing a process of reducing the amount of the another ink applied for forming an image in the area in a case that an affirmative judgment is made by the judgment means.

2. An ink jet printing apparatus as claimed in claim 1, wherein, in a case that there is an item of image data causing the another ink to be ejected onto the position onto which the one ink is to be preliminarily ejected, the ink-application-amount reduction means deletes this item of the image data.

3. An ink jet printing apparatus as claimed in claim 1, wherein, in a case that there are items of image data causing the another ink to be ejected onto the vicinity of the position where the one ink is to be preliminarily ejected, the ink-application-amount reduction means thins the image data.

4. An ink jet printing apparatus as claimed in claim 3, wherein complemental printing is made for the thinned items of the image data, after the preliminary ejection.

5. An ink jet printing apparatus as claimed in claim 4, wherein the printing head is scanned on the printing medium in a direction different from a direction in which nozzles are arranged, and the complemental printing is performed in a scanning different from a scanning in which the preliminary ejection is performed.

6. An ink jet printing apparatus as claimed in claim 1, wherein the ink-application-amount reduction means reduces the amount of the another ink ejected onto the position where the one ink is preliminarily ejected.

7. An ink jet printing apparatus as claimed in claim 1, wherein the ink-application-amount reduction means reduces the amount of the another ink ejected onto the vicinity of the position where the one ink is preliminarily ejected.

8. An ink jet printing apparatus as claimed in claim 1, further comprising:

second judgment means for judging whether or not the preliminary ejection is necessary; and determination means for determining a position onto which the preliminary ejection is performed in a case that the second judgment means judges that the preliminary ejection is necessary, wherein the reduction process is performed in a case that the determined position exists in an area onto which the ink of higher lightness is ejected.

9. An ink jet printing apparatus as claimed in claim 8, wherein the second judgment means makes a judgment according to a period of time when a nozzle is not in use.

10. An ink jet printing apparatus as claimed in claim 1, wherein the another ink is at least one of a yellow ink, a light cyan ink and a light magenta ink.

11. An ink jet printing apparatus as claimed in claim 1, wherein the reduction process is performed only in a case where the another ink is applied to the area before the one ink is preliminarily ejected.

12. An ink jet printing method which prints an image on a printing medium by ejecting inks having different lightness on the printing medium by using an ink jet printing head capable of ejecting the inks, and which can preliminarily eject the inks on the printing medium while printing the image, the ink jet printing method comprising the steps of:

judging whether or not, onto an area including a position where one ink is to be preliminarily ejected and the vicinity of the position, another ink of higher lightness than that of the one ink to be preliminarily ejected is to be ejected; and performing a process of reducing the amount of the another ink applied for forming an image in the area in a case where an affirmative judgment is made in the judging step.

* * * * *